US012759746B1

(12) United States Patent
Forbes et al.

(10) Patent No.: US 12,759,746 B1
(45) Date of Patent: Oct. 13, 2026

(54) CORRUGATED UNIT DUNNAGE TOPPER SYSTEM

(71) Applicant: 20/20 Robotics, LLC, Anna, OH (US)

(72) Inventors: Michael B. Forbes, Durham, NC (US); Ryan D. Norkett, Lacona, NY (US); Austin Black, Wapakoneta, OH (US); Garrett Black, Chicago, IL (US)

(73) Assignee: 20/20 Robotics, LLC, Anna, OH (US)

( * ) Notice: Subject to any disclaimer, the term of this patent is extended or adjusted under 35 U.S.C. 154(b) by 0 days.

(21) Appl. No.: 19/255,493

(22) Filed: Jun. 30, 2025

(51) Int. Cl.
*B65B 57/00* (2006.01)
*B65B 55/00* (2006.01)
*B65B 57/12* (2006.01)

(52) U.S. Cl.
CPC ..... *B65B 57/12* (2013.01); *B65B 55/00* (2013.01); *B65B 2210/04* (2013.01)

(58) Field of Classification Search
CPC ..... B65B 57/12; B65B 55/00; B65B 2210/04; B65B 61/20; B25J 9/1697; B25J 9/1679; G05B 2219/40006
USPC ..... 53/410
See application file for complete search history.

(56) References Cited

U.S. PATENT DOCUMENTS

2010/0185329 A1* 7/2010 Parker ..... B25J 9/1669 901/30

* cited by examiner

*Primary Examiner* — Jacob A Smith
(74) *Attorney, Agent, or Firm* — Slater Matsil, LLP

(57) ABSTRACT

Systems and methods for placing dunnage on top of packaged products such as corrugated units, where the method may include receiving a corrugated unit to a preset position; analyzing, using a first vision system, the corrugated unit to determine a size, shape, and position of the corrugated unit; determining, from the size, shape, and position of the corrugated unit, a dunnage material size and placement on the corrugated unit; and picking with a robotic manipulator a piece of dunnage material that matches the dunnage material size from a plurality of dunnage material stacks. The robotic manipulator then presents the piece of dunnage material to a second vision system to determine alignment information; and aligns the piece of dunnage material based on feedback from the second vision system. Other embodiments are discussed herein.

18 Claims, 7 Drawing Sheets

CORRUGATED UNIT DUNNAGE TOPPER SYSTEM

TECHNICAL FIELD

Disclosed embodiments are directed to systems and methods for managing production processes, and specifically to systems and methods for picking and placing dunnage material on palletized goods.

BACKGROUND

Production processes for manufacturing goods may involve multiple steps, starting with various raw materials, to progressively form the desired finished product. Often these steps are determined by engineering considerations, where the operations necessary to form the final product from a given starting material(s) are analyzed to determine how they can be best carried out using automation. Sometimes, this may require breaking down a single step that may be performed manually into multiple steps that are better suited to automated operation. Once the steps to form a manufactured good are determined, a production line or process may be designed.

In the corrugated box industry, customers purchase boxes in "units". These units are either pre-folded boxes or sheets of corrugate that are stacked either onto a pallet or directly onto a conveyor, then strapped to prevent movement of the product during shipping. During the corrugate production process, in order to protect the edges of the top sheet of the unit from damage by the straps, an additional scrap piece or pieces of corrugate, called "dunnage", is/are placed on top of the unit. Dunnage may also be used as protective packing material in contexts other than corrugated boxes and paper, such as when other types of goods are palletized or otherwise packed using strapping material or other means for securing goods that could mar or otherwise damage the packed goods. The edges of the dunnage may be folded over the top edges of the unit to protect the sheets when straps are applied to them. This process is typically done by a human, deciding what the correct size of dunnage should be, picking scrap pieces of material either from a series of stacks or often from a large pile of scrap pieces, then placing them on top of the unit. This is often a slow and cumbersome process and it can bottle-neck the production process if and when the operator cannot keep up with the production rate of units.

To address this problem, either the production process must be slowed so that the packing station does not get backed up, additional storage must be built to house products waiting for their turn to be packed, and/or additional packing stations must be provided so that products can be packed in parallel at a pace that keeps up with production. Any of these options can result in increased production overhead and/or costs.

The background description provided herein is for the purpose of generally presenting the context of the disclosure. Unless otherwise indicated herein, the materials described in this section are not prior art to the claims in this application and are not admitted to be prior art by inclusion in this section.

SUMMARY OF THE INVENTION

According to first aspect, a method comprises receiving into a predefined space a corrugated unit to a preset position; analyzing, using a first vision system, the corrugated unit to determine a size, shape, and position within the predefined space of the corrugated unit; determining, from the size, shape, and position of the corrugated unit, a dunnage material size and placement on the corrugated unit; picking, using a robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions; presenting, by the robotic manipulator, the piece of dunnage material to a second vision system to determine alignment information; and aligning, by the robotic manipulator based on feedback from the second vision system, the piece of dunnage material to the corrugated unit based on the alignment information.

In a first possible embodiment of the first aspect, the robotic manipulator is controlled by a programmable logic controller (PLC).

In a second possible embodiment of the first aspect, the PLC receives input from the first vision system and the second vision system, and uses the input to control the robotic manipulator.

In a third possible embodiment of the first aspect, the corrugated unit is received into the predefined space to the preset position via a conveyor.

In a fourth possible embodiment of the first aspect, the method further comprises placing, by the robotic manipulator, the piece of dunnage material onto the corrugated unit according to the determined placement and the alignment information.

In a fifth possible embodiment of the first aspect, the method further comprises providing, by the robotic manipulator, the piece of dunnage material to a folding station to fold one or more edges of the piece of dunnage material; and placing, by the robotic manipulator, the folded piece of dunnage material onto the corrugated unit according to the determined placement and the alignment information.

According to a second aspect, a system, comprises a first vision system; a second vision system; a robotic manipulator; and a programmable logic controller (PLC) in data communication with the first vision system, the second vision system, and the robotic manipulator. The PLC is programmed to analyze, using input from the first vision system, a packaged product to determine a size, shape, and position within a predefined space of the packaged product; determine, from the size, shape, and position of the packaged product, a dunnage material size and placement on the packaged product; pick, using the robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions; present, with the robotic manipulator, the piece of dunnage material to the second vision system to determine alignment information; and align, by the robotic manipulator based on feedback from the second vision system, the piece of dunnage material to the packaged product based on the alignment information.

In a first possible embodiment of the second aspect, the packaged product is received into the predefined space to a preset position via a conveyor.

In a second possible embodiment of the second aspect, the first vision system, the second vision system, or both, comprise 3D cameras.

In a third possible embodiment of the second aspect, the PLC is further programmed to place, with the robotic manipulator, the piece of dunnage material onto the packaged product according to the determined placement and the alignment information.

In a fourth possible embodiment of the second aspect, the PLC is further programmed to provide, with the robotic manipulator, the piece of dunnage material to a folding station to fold one or more edges of the piece of dunnage material; and place, with the robotic manipulator, the folded piece of dunnage material onto the packaged product according to the determined placement and the alignment information.

In a fifth possible embodiment of the second aspect, the packaged product is a corrugated unit.

According to a third aspect, a non-transitory computer readable medium (CRM) comprises instructions that, when executed by an apparatus, cause the apparatus to analyze, using input from a first vision system, a corrugated unit to determine a size, shape, and position within a predefined space of the corrugated unit; determine, from the size, shape, and position of the corrugated unit, a dunnage material size and placement on the corrugated unit; pick, using a robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions; present, with the robotic manipulator, the piece of dunnage material to a second vision system to determine alignment information; and align, with the robotic manipulator based on feedback from the second vision system, the piece of dunnage material to the corrugated unit based on the alignment information.

In a first possible embodiment of the third aspect, the corrugated unit is received into the predefined space to a preset position via a conveyor.

In a second possible embodiment of the third aspect, the first vision system, the second vision system, or both, comprise 3D cameras.

In a third possible embodiment of the third aspect, the instructions further cause the apparatus to place, with the robotic manipulator, the piece of dunnage material onto the corrugated unit according to the determined placement and the alignment information.

In a fourth possible embodiment of the third aspect, the instructions further cause the apparatus to provide, with the robotic manipulator, the piece of dunnage material to a folding station to fold one or more edges of the piece of dunnage material; and place, with the robotic manipulator, the folded piece of dunnage material onto the corrugated unit according to the determined placement and the alignment information.

In a fifth possible embodiment of the third aspect, the apparatus is a programmable logic controller that is in data communication with the first vision system, the second vision system, and the robotic manipulator.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
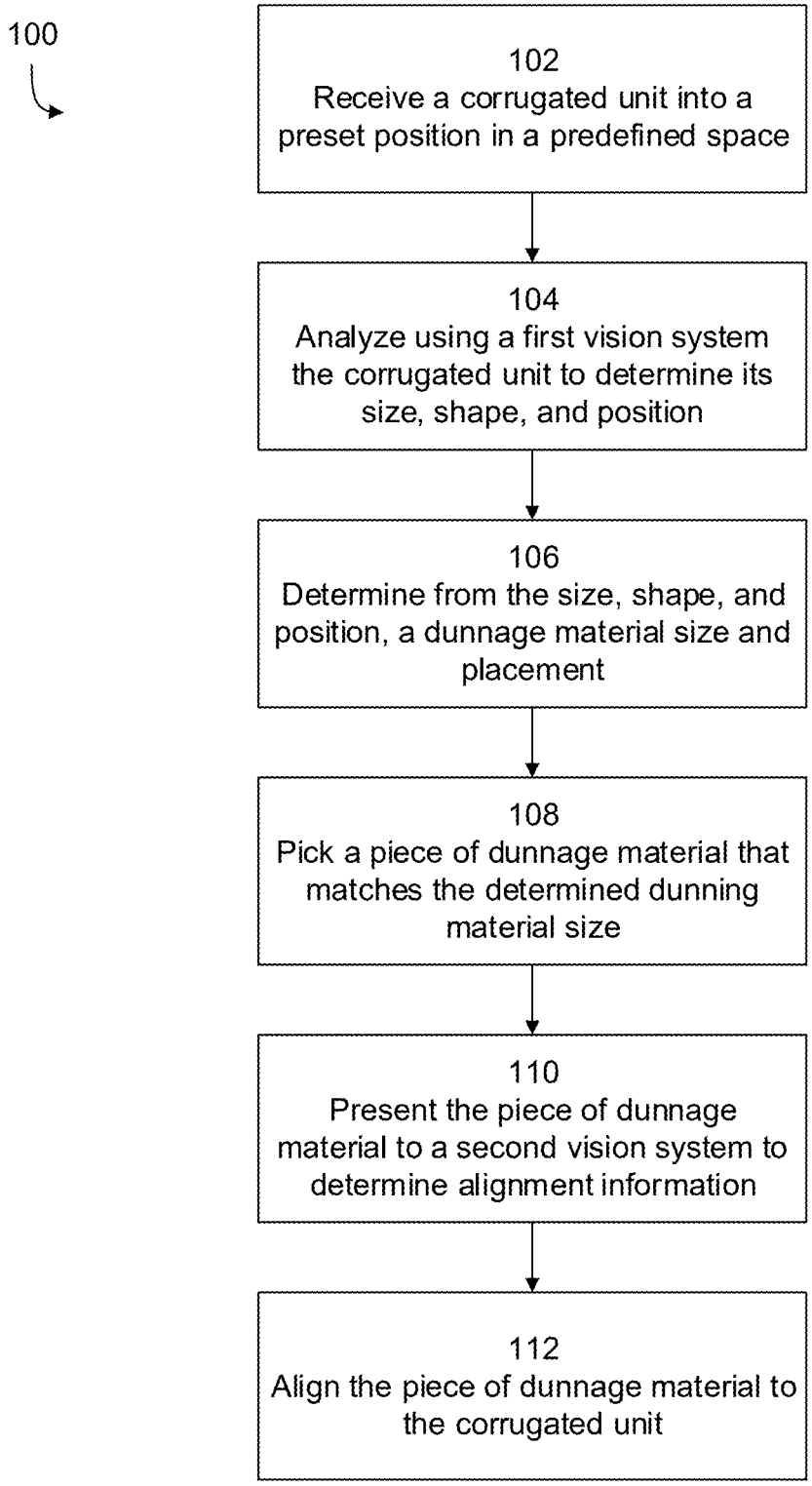
FIG. 1 illustrates an example method for selecting and placing dunnage material on top of a corrugated unit, according to various embodiments.

Because the current process of having a person manually pick appropriately-sized pieces of dunnage acts as a limiting factor for speed of a production line, such as a packing line where goods are boxed, palletized, or otherwise prepped for shipping, a system and method that can automate selection and placement of dunnage material can save significant amounts of time and/or money. By automating the process of selecting and placing dunnage material onto a corrugated unit or other packed product, the speed of selection and placement can be greatly increased, and so production can be maintained at a greater pace without the need for storage to hold products awaiting packing or setting up and manning multiple stations for placement of dunnage. While examples provided herein focus on corrugated units for placement of dunnage, it should be understood by the reader that the methods and systems disclosed herein are not limited in function to just the corrugated box industry, but can be utilized in any setting where picking and placement of dunnage or other similar packing materials into packed goods can benefit from automation. It can be used for placing many types of dunnage or top sheet on top of almost any product that is transported on pallets, or similar packing forms.

Embodiments of disclosed dunnage topper systems and methods utilize multiple machine vision systems to determine proper dunnage size and guide a robot manipulator to accurately place the dunnage on a corrugated unit (or other packed good, box, pallet, etc.), regardless of inconsistencies in size or shape of units. Disclosed embodiments work by the following process:

In an example embodiment, a unit of corrugate product enters into the dunnage topper workspace via a conveyor system. When the unit has arrived to a set or predetermined position, the unit is inspected using a first machine vision system, such as a 3D camera system, in order to determine the size, shape and location of the corrugated unit. This information is then fed to a programmable logic controller (PLC), and then to the robot manipulator for proper placement of the dunnage sheet. It will be understood that, in various embodiments, the PLC controls the robot manipulator. The size and shape information allows the system to determine which size sheet to pick. The location information will ensure that the robot manipulator places the dunnage sheet properly on top of the unit, even if it is skewed on the conveyor or has stopped in a slightly different spot than anticipated.

Once the size and shape information is sent to the PLC and robot manipulator using the first vision system, the robot manipulator is guided to pick and place top a dunnage sheet onto units of corrugated boxes. In embodiments, the system utilizes the robot manipulator to pick a single piece of dunnage from one of several locations. Each dunnage location can contain different size dunnage sheets corresponding to different possible corrugated unit sizes in order to properly fit them to a current unit size. Once picked, the robot manipulator may present the picked dunnage sheet to a second vision system, such as a camera system, which feeds locational information to a PLC and then to the robot manipulator to align the dunnage to the corrugated unit. This inspection by the second vision system ensures that the selected sheet picked by the robot manipulator has been picked in the proper location for accurate placement upon the corrugated unit. If the sheet is determined by the second vision system to be misaligned, it will send this information to the PLC, which then relays the info to the robot manipulator to correct the placement of the dunnage sheet on top of the unit. After the dunnage sheet has been picked and inspected using the second vision system, it can be placed directly onto the corrugated unit or it can be presented to a folding station to fold the edges of the dunnage sheet prior to placement on the unit.

In various embodiments, the use of cameras, in embodiments, can be combined with machine learning (ML) and/or other types of artificial intelligence (AI), e.g., artificial neural networks (ANNs), to enhance recognition of the size of a corrugated unit and matching to an appropriate dunnage size. With this ML-enhanced recognition, aspects of the dunnage topper system may be controlled, e.g. modifying the speed of equipment such as the conveyor system and/or robot manipulator, providing accurate determination of dunnage placement, determining if any unusual shapes are present, whether multiple dunnage pieces are needed, etc.

In the following detailed description, reference is made to the accompanying drawings which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that like elements disclosed below are indicated by like reference numbers in the drawings.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

As used herein, the term "circuitry" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

FIG. 1 is an example method 100 of the operations for selection and placement of dunnage on top of a corrugated unit. The operations of method 100 may be carried out in whole or in part, depending upon the needs of a given embodiment. Further, some operations may be omitted, some operations may be added, and the order of operations may be rearranged depending upon the requirements of a given embodiment. The operations of method 100 may be carried out by one or more components of an example system, such as system 200 discussed below with respect to FIG. 2. Some or all operations may be carried out by a server, a programmable logic controller (PLC) and/or by another device within the system. Moreover, some aspects of a given operation may be instead carried out as part of a different operation, depending upon the specifics of a given implementing system.

In operation 102, in some embodiments, a corrugated unit is received into a predefined space, the predefined space comprising an area in which a robotic manipulator can operate on materials. The corrugated unit may be delivered to the predefined space via a mechanism such as a conveyor belt or system, which may transport the corrugated unit from previous processing stations to a fixed or preset position within the predefined space. The preset position, in embodiments, will be within the field of view of a first vision system for subsequent analysis of the corrugated unit. Further, the preset position may be within a specific defined area within the predefined space for which the robotic manipulator is programmed to expect the corrugated unit.

In other embodiments, other mechanisms for receiving the corrugated unit into the predefined space may be utilized, such as pallet handling equipment (e.g., pallet jacks, forklifts, power lifts, etc.) or manual handling. In some implementations, the corrugated unit may be palletized (or otherwise packed or prepared) in place in the predefined space. In still other implementations, the dunnage topper system may be placed on a mobile platform and taken to each corrugated unit, rather than transporting the corrugated unit to the dunnage topper system. Any suitable system for positioning a corrugated unit (or other packaged or palletized product) may be utilized.

In operation 104, once the corrugated unit is positioned in the preset position, the first vision system is used to analyze the corrugated unit, to determine its size and shape, and its position within the predefined space. This analysis may be performed using any suitable algorithm, such as an object detection algorithm, edge detection, photogrammatic techniques to determine lengths and areas of the corrugated unit, and/or any other algorithm now known or later developed for analysis of objects. The selection of algorithm or algorithms may depend upon the nature of the first vision system, such as type of sensor (camera, LIDAR, IR sensors, etc.), whether the sensor is capable of 3D capture (e.g., a 3D camera), and the type of processing system in communication with the first vision system (e.g., a programmable logic controller, local server, cloud-based processing, etc.). The result of the algorithm, in some embodiments, may be data of the size and shape of the corrugated unit, as well as its actual position within the predefined space. This information may be used in subsequent analysis for selection of a dunnage piece as well as directing the robotic manipulator.

As mentioned above, the preset position is a position that ensures the corrugated unit is sufficiently within the first vision system's field of view such that the analysis can be accurately carried out. The size of the preset position will depend upon the location of the first vision system, as well as aspects of the first vision system such as its field of view. In some implementations, the first vision system may be capable of adjusting its field of view, such as by employing a variable zoom lens or lenses or mounting of the first vision system on a movable platform. In implementations where the first vision system may be mounted on a moveable platform, the position of the first vision system may be adjusted around the corrugated unit to obtain an ideal viewpoint to maximize accuracy of the analysis of the corrugated unit. This adjustment may be performed by any suitable technique, such as by using a feedback loop, and may be performed by the processing system and/or by a separate controller in communication with the first vision system and/or processing system.

In operation 106, a size of a piece or pieces of dunnage material are determined or otherwise selected based on the size and shape of the corrugated unit, as evaluated in operation 104. In embodiments, the analysis of operation 104 may indicate a size and shape of a top surface of the corrugated unit, on which at least one piece of dunnage material may be placed. The analysis may include an estimation of where straps will be placed as well as a possible tension needed to secure the straps (which may be based on estimates of the corrugated unit weight and how secure the contents of the unit need to be) so that dunnage material can be placed in appropriate positions to protect the contents of the corrugated unit. Furthermore, this information may also determine the shape of the dunnage piece to be selected. In some instances, multiple dunnage pieces may be necessary, such as where the analyzed size and/or shape of the corrugated unit exceeds the size of any one piece of available dunnage such that employing one piece would be insufficient to protect the contents of the corrugated unit. The determination in operation 105 may be performed by the processing system mentioned above.

Also, the size and shape of available dunnage pieces may factor into the determination, with a given system implementing method 100 making different selections where the selection of available pieces of dunnage varies. For example, if an implementing system is provided with primarily small dunnage pieces, it may determine that multiple pieces are necessary to properly protect the corrugated unit contents, while the same system may determine that only a single piece is necessary when the system is supplied with relatively larger sized dunnage pieces.

In operation 108, in embodiments, a piece of dunnage material is selected that matches the determined size of the piece or pieces of dunnage material. As mentioned above, an implementing system may be provided with a plurality of different types and/or stacks of dunnage, with the number and selection of stacks of dunnage based on the typical size of the corrugated units. In some implementations, each stack of a plurality of stacks may have a relatively consistent size, so that selecting a given piece of dunnage material may only require directing the robotic manipulator to the correct stack (or stacks, if it is determined that a plurality of different sized dunnage material is necessary). In other implementations, pieces of dunnage in a given stack may vary to some extent in size and/or shape, and so a second vision system may be employed to verify that a selected piece of dunnage is a correct size and/or shape.

In operation 110, the piece of dunnage selected in operation 108 may be presented to the second vision system, to determine alignment information for proper placement on the top of the corrugated unit. The second vision system may be similar to the first vision system, or may be different, depending upon the specifics of a given implementation. In some implementations, the robotic manipulator may be commanded by the processing system to position the selected piece of dunnage within a field of view of the second vision system, which in turn may be positioned to monitor the selection of dunnage pieces and/or placement of the dunnage pieces onto a corrugated unit.

In some implementations, positioning of the selected piece of dunnage may involve the robotic manipulator holding a selected piece at an intermediate position for inspection by the second vision system. In other implementations, the second vision system may be positioned to have a clear view of the top of the corrugated unit, and presentation of the selected piece of dunnage may involve placing the dunnage on top of the corrugated unit, at least temporarily, for analysis via the second vision system. When placed atop the corrugated unit, the second vision system can be used to verify a proper alignment of the selected dunnage piece. Furthermore, such feedback from the second vision system may be used to determine if a second (or more) piece of dunnage material is needed, and to determine an optimal arrangement of multiple pieces of dunnage. For example, if a corrugated unit will have two straps that will engage with the corrugated unit contents at four points, the system may determine that four pieces of dunnage material are needed, one for each point at which the straps will contact the edges of the corrugated unit contents. With awareness of where the straps will cross the top of the corrugated unit, dunnage material can be accurately placed prior to the straps being affixed.

Finally, in operation 112, the selected piece (or pieces) of dunnage material is aligned to the corrugated unit. Operations 110 and 112 may be performed iteratively, with the second vision system used to determine a possible misalignment. If a misalignment is detected, the processing system may command the robotic manipulator to adjust the position of the dunnage material into an aligned position, with the progress of the adjustment monitored by the second vision system until it is determined that an acceptable alignment is achieved. Further, operations 110 and 112 may be repeated for each selected piece of dunnage, where the corrugated unit requires multiple pieces of dunnage.

Figure 2:
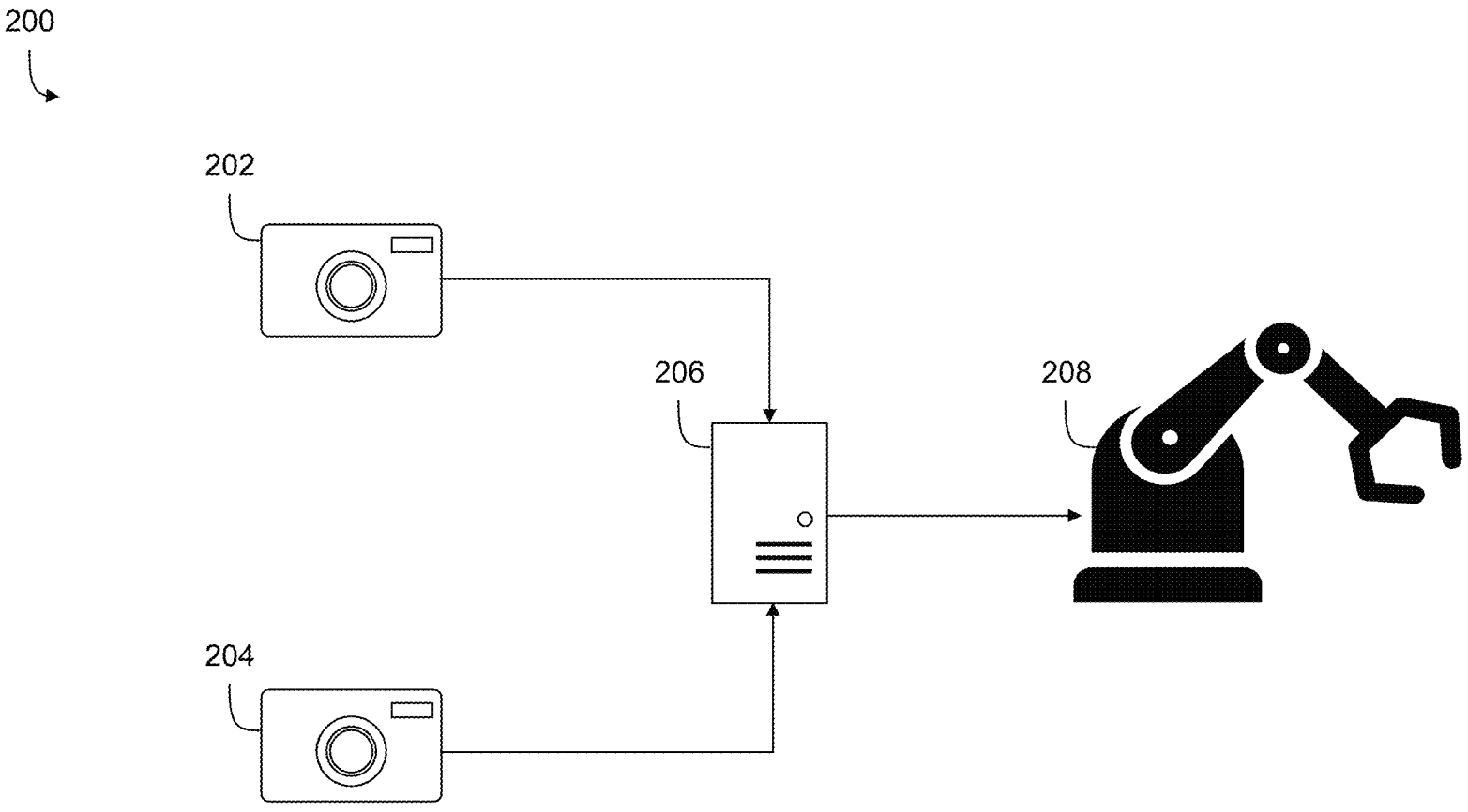
FIG. 2 illustrates an example system for selecting and placing dunnage material that may implement the method of FIG. 1, according to various embodiments.

Turning to FIG. 2, an example system 200 that could be used to implement method 100 is depicted. System 200 may include a first vision system that includes a first camera 202, a second vision system that includes a second camera 204, a processing system 206, and a robotic manipulator 208. How these various components interact is discussed above with respect to FIG. 1 and method 100.

Cameras 202 and 204, in the depicted embodiment, each feed an image stream to server 206 in a format suitable for central server 206 to analyze for accurately determining the size and location of a corrugated unit as well as a selected dunnage piece. The cameras 202 and 204 may directly connect to server 206, or may communicate with an intermediate hub (not depicted) which in turn communicates with the server 206. The cameras 202 and/or 204 may connect to the server 206 using wired or wireless communications technologies, or a combination of both, depending upon the need of a given implementation. Each camera 202 and 204 is positioned at a location appropriate for fulfilling its purpose. Where camera 202 is the first vision system, it may be placed relative to the preset position such that it will have a view of the corrugated unit sufficient to allow the size, shape, and position of the corrugated unit to be analyzed and determined. Where camera 204 is the second vision system, it may be placed relative to the robotic manipulator 208 and dunnage stacks such that it can view a selected dunnage piece when presented by the robotic manipulator 208, for verification that a correct size has been selected and the dunnage piece has been properly aligned to the corrugated unit. In either cause, cameras 202 and 204 may be placed at a point where the camera is unlikely to be struck by moving machinery or objects.

As mentioned above with respect to method 100, each camera 202 and 204 may be implemented using any suitable imaging technology. In some embodiments, the cameras may be implemented using RGB-sensitive cameras, comparable to those commonly found in smartphones, digital cameras, etc. Such cameras may be off-the-shelf, such as surveillance cameras, webcams, or similar video cameras. In other embodiments, one or more of the cameras 202 and/or 204 may be purpose-built for a specific embodiment, appropriate for a given aspect of the dunnage topping process. Some examples of variations could include stereoscopic cameras that are capable of detecting depth information of an imaged object, scanning equipment such as LIDAR imager that may be able to generate a 3D point cloud representation of a corrugated unit and/or dunnage piece, or a camera configured to detect non-visible light (e.g., ultraviolet, infrared, etc.), a camera equipped with a zoom lens system, an imager capable of detecting into low-light conditions, or a combination of one or more of the foregoing, etc. Camera 202, part of the first vision system, may be different in type from camera 204, part of the second vision system, as each camera is used for a different purpose. For example, camera 202 may be a 3D camera to collect depth information of the corrugated unit, while camera 204 may be an RGB or even monochrome camera, as it is used to inspect selected dunnage pieces as well as confirm alignment of the pieces to the corrugated unit.

Information from cameras 202 and 204 may be fed to and used by server 206 to direct the robotic manipulator 208 in selecting and positioning one or more dunnage pieces, or any other control operation that may be required by a given implementation.

Server 206 may be any computing system suitable for receiving and processing input from cameras 202 and 204, which may be in data communication with server 206, and outputting controls to robotic manipulator 208 in response, which also may be in data communication with server 206. In some embodiments, server 206 may comprise at least in part of one or more programmable logic controllers (PLCs). In other embodiments, server 206 may be a locally-based or remotely connected computer, such as a general purpose computer or computing device, file server, purpose-built server, or a cloud service. In still other embodiments, server 206 may be a custom designed device, which may be implemented with discrete components, integrated circuits, programmable arrays, application-specific integrated circuits, or some combination of any of the foregoing. Server 206 may be implemented as a single unit or multiple units, in a centralized or decentralized fashion. The specifics of a given server 206 may depend on the needs of a given implementation.

In some embodiments, server 206 may utilize artificial intelligence (AI) of a suitable type, such as one or more machine learning (ML) algorithms, which may include one or more artificial neural networks (ANNs). The ML algorithm, in embodiments, may be configured and/or trained to detect aspects such as the size, shape, and position of a corrugated unit, and further to output an ideal selection of one or more dunnage pieces. The ML algorithm may further be trained to understand the specific selection of dunnage pieces available to the system 200, and may employ such a trained ML system to determine an optimal selection and position of various pieces of dunnage material to provide good or ideal protection to the contents of the corrugated unit.

As discussed above, server 206 controls various aspects of the dunnage topping process, such as performed by method 100 of FIG. 1 above. The method 100 may be performed by server 208 on the basis of input from the cameras 202 and 204, as parts of the first vision system and the second vision system, respectively. In embodiments, such control may include: instructing the robotic manipulator to move according to its capabilities and configuration to select one or more pieces of dunnage from a plurality of dunnage piles, and align and place the dunnage pieces onto the corrugated unit, instructing movements of camera 202 and/or camera 204, if mounted on a movable support, adjustment of a conveyor speed, if a conveyor is used to initially position a corrugated unit, and possibly operation of additional equipment, such as a folding station (not shown) or strapping station (not shown). As mentioned above with reference to FIG. 1, server 206 may perform operations iteratively, such as when input is received from camera 204 as part of the second vision system. Such input may be used to make adjustments to alignment of a piece of dunnage on the basis of making an initial adjustment, followed by assessment of alignment based on input from the second vision system, followed again by a further adjustment in response to the input. This process may repeat iteratively until a desired alignment of a dunnage piece is achieved.

Robotic manipulator 208 may be any suitable robotic mechanism that can be configured to pick up, manipulate, and place pieces of dunnage on top of a corrugated unit. In some implementations, robotic manipulator 208 may be a robotic arm, which may have a grip attachment. Robotic manipulator 208 may have three, four, five, six, or more degrees of freedom or motion, as necessary to effect its job. The reach of robotic manipulator 208 may define a working space that is the predefined space mentioned above, where objects must be at least partially within the working space for the robotic manipulator 208 to interact with them. The robotic manipulator 208 may respond to commands from server 206 (such as a PLC) to effect its motion for carrying out dunnage topping.

In some embodiments, only a single robotic manipulator 208 may be present. In other embodiments, there may be multiple robotic manipulators, where each may be configured to perform a specific task or part of method 100, above. Where there are a plurality of robotic manipulators, two or more may be of a different type, with a given type selected based on suitability to its intended task. For example, there may be a first robotic manipulator 208 responsible for delivering or positioning a dunnage piece, while there may be a second robotic manipulator 208 that accepts a dunnage piece and transfers it to a corrugated unit, and a third robotic manipulator 208 that aligns the placed dunnage piece atop the corrugated unit. As will be understood by a person skilled in the relevant art, each such robotic manipulator 208 may be of a configuration suitable to its specific task, and so may differ from the other robotic manipulators. In still another implementation, robotic manipulator 208 may be a general purpose robotic arm or manipulator that can be programmed to execute a wide array of tasks.

Figure 3:
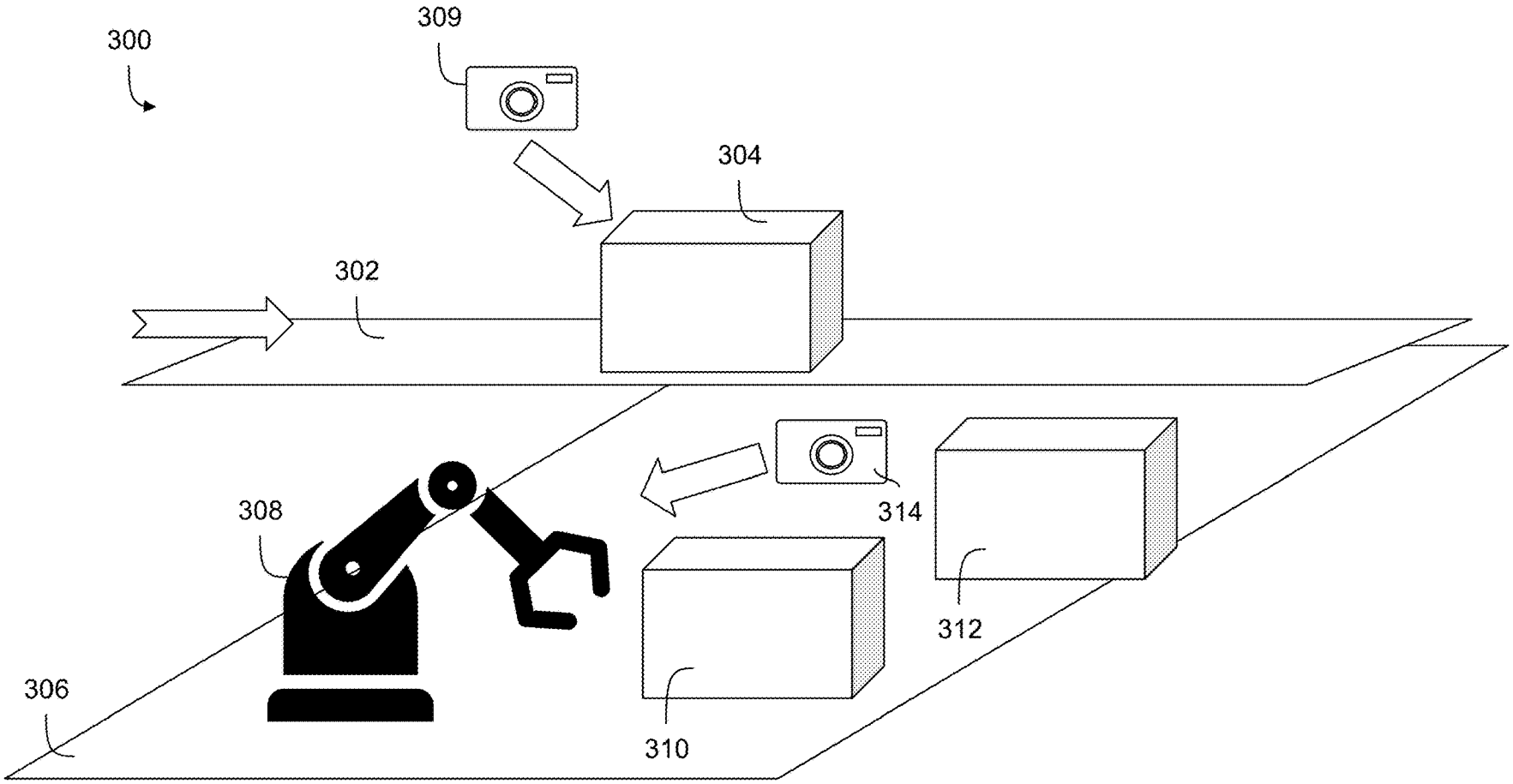
FIG. 3 depicts a process flow of a possible implementation of the system of FIG. 2, according to various embodiments.

FIG. 3 depicts a process flow 300 of how an example system, such as system 200, may perform a method 100. How various components work is explained above with respect to FIGS. 1 and 2, and will not be repeated here; the reader is directed to the foregoing discussions.

In process flow 300, a conveyor 302 delivers a corrugated unit 304 to a preset position within a predefined space 306. As mentioned above, the size and shape of the predefined space 306 may depend upon the type and capabilities of robotic manipulator 308. Conveyor 302, as mentioned above with respect to method 100, may be implemented using a variety of different mechanisms to deliver a corrugated unit 304.

Once corrugated unit 304 is in a preset position, it is analyzed by a camera that is part of first vision system 309. First vision system 309 determines the size and shape of corrugated unit 304, as well as its precise position relative to robotic manipulator 308, so that robotic manipulator 308 can more precisely align selected dunnage pieces.

Following corrugated unit 304 being in its preset position and analysis via first vision system 309, a PLC or other server (not shown) in communication with the first vision system 309, robotic manipulator 308, and a second vision system 314, commands the robotic manipulator 308 to select a piece of dunnage material. In the depicted embodiment, dunnage material is present within the predefined space 306 as a first dunnage material stack 310, and a second dunnage material stack 312. Dunnage material in stack 310 may be of a different size and/or shape from the dunnage material in stack 312.

The robotic manipulator 308, under control of the PLC, selects an appropriate dunnage piece from one of the stacks 310 or 312 based on input from first vision system 309 and analysis of this input, and presents the selected dunnage piece to a camera that is part of second vision system 314. This presentation, as mentioned above, may be prior to placement on the corrugated unit 304, or after placement. The second vision system 314 may then ascertain the alignment of the selected dunnage piece, and may further help determine if additional dunnage pieces are needed, and if so, there appropriate placement.

It should be understood that, in some embodiments, tasks described above as carried out by first vision system 309 may be carried out by second vision system 314. In other embodiments, the first vision system 309 and second vision system 314 may be the same system, viz. there is only a single vision system that provides both the analysis of the corrugated stack, as well as inspection of the selected dunnage piece and determination of proper alignment.

Once the selected dunnage piece or pieces have been picked and aligned for corrugated unit 304, they may be placed on top of the corrugated unit 304, which then may be secured with strapping or other package closures, such as staples, cords, tape, etc. Optionally, prior to placement and securing, a selected dunnage piece may first be folded by a folding station (not shown; discussed below) to make the piece conform to the top contours and edges of the corrugated unit 304. Where multiple dunnage pieces are selected and applied to a given corrugated unit 304, only some of the dunnage pieces may be folded.

Figure 4:
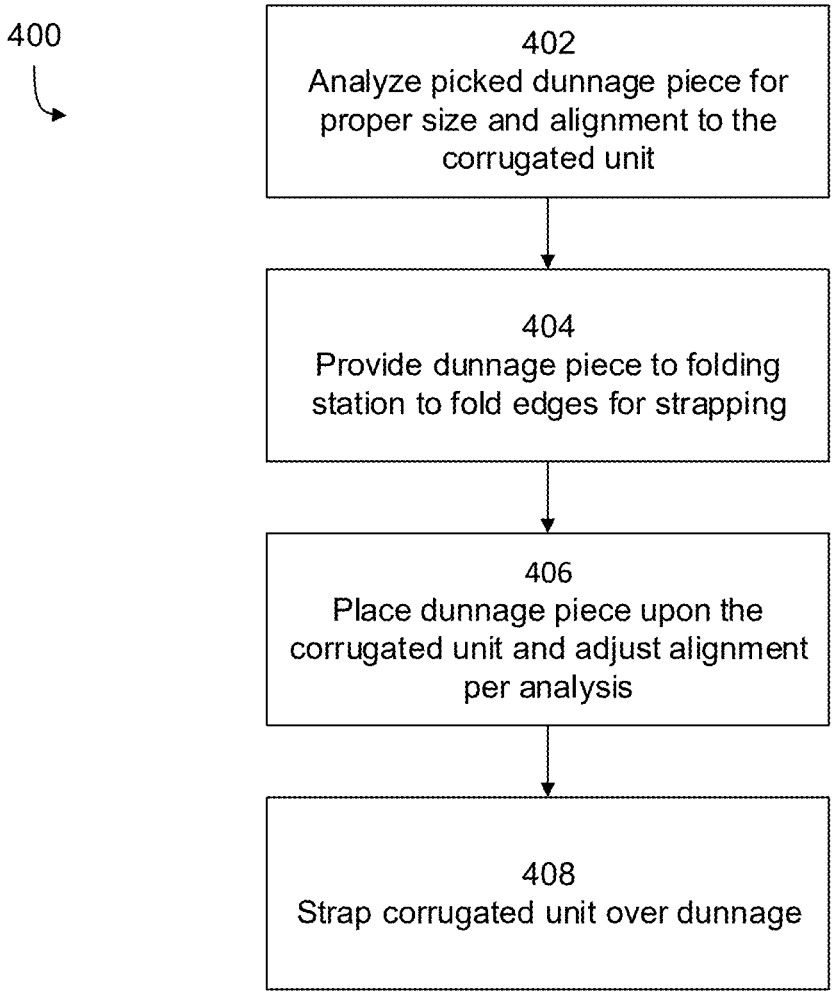
FIG. 4 illustrates an example method for processing a picked dunnage piece through a folding station and securing to a corrugated unit, according to various embodiments.

FIG. 4 is an example method 400 of additional operations that may be performed as part of or a continuation of example method 100 (FIG. 1). The reader is referred to FIG. 1 above for a description of method 100 and its associated operations. The operations of method 400 may be carried out in whole or in part, depending upon the needs of a given embodiment. Further some operations may be omitted, some operations may be added, and the order of operations may be rearranged depending upon the requirements of a given embodiment. The operations of method 400 may be carried out by one or more components of a system, such as system 100. Some or all operations may be carried out by a server, and/or by another device within the system, or both. Moreover, some aspects of a given operation may be instead carried out as part of a different operation, depending upon the specifics of a given implementing system.

In operation 402, in embodiments, picked dunnage pieces are analyzed for proper size and alignment to the corrugated unit. Operation 402 essentially corresponds to operations 110 and 112 of method 100, which may be performed iteratively. The reader is directed to the description of method 100 above for further details, which will not be repeated here. Furthermore, as part of this analysis, the shape of the corrugated unit may be considered to determine whether the dunnage piece should be folded to better protect the contents of the corrugated unit.

Following analysis of the picked dunnage piece and determining that the dunnage piece should be folded, in operation 404 of embodiments, the dunnage piece may be provided to a folding station (not shown), which may fold the edges of the dunnage material to conform to at least a portion of the top of the corrugated unit. The folding station may be controlled by the same server or processing system that controls the system 200, and so may be instructed to fold the dunnage in a specific fashion that is most suitable for the corrugated unit. In some implementations, the folding station may also or alternatively be able to cut or otherwise reform or reshape a selected dunnage piece to better conform to the needs of the corrugated unit. In this way, the system 200 implementing methods 100 and 400 can essentially automate the process of selecting, modifying, and placing dunnage on a corrugated unit.

In operation 406, once the folding station is completed, the dunnage piece may be placed upon the corrugated unit. Using feedback from a second vision system, as discussed above, the alignment of the folded/modified dunnage piece may be adjusted by the robotic manipulator to achieve an optimal position.

Figure 5:
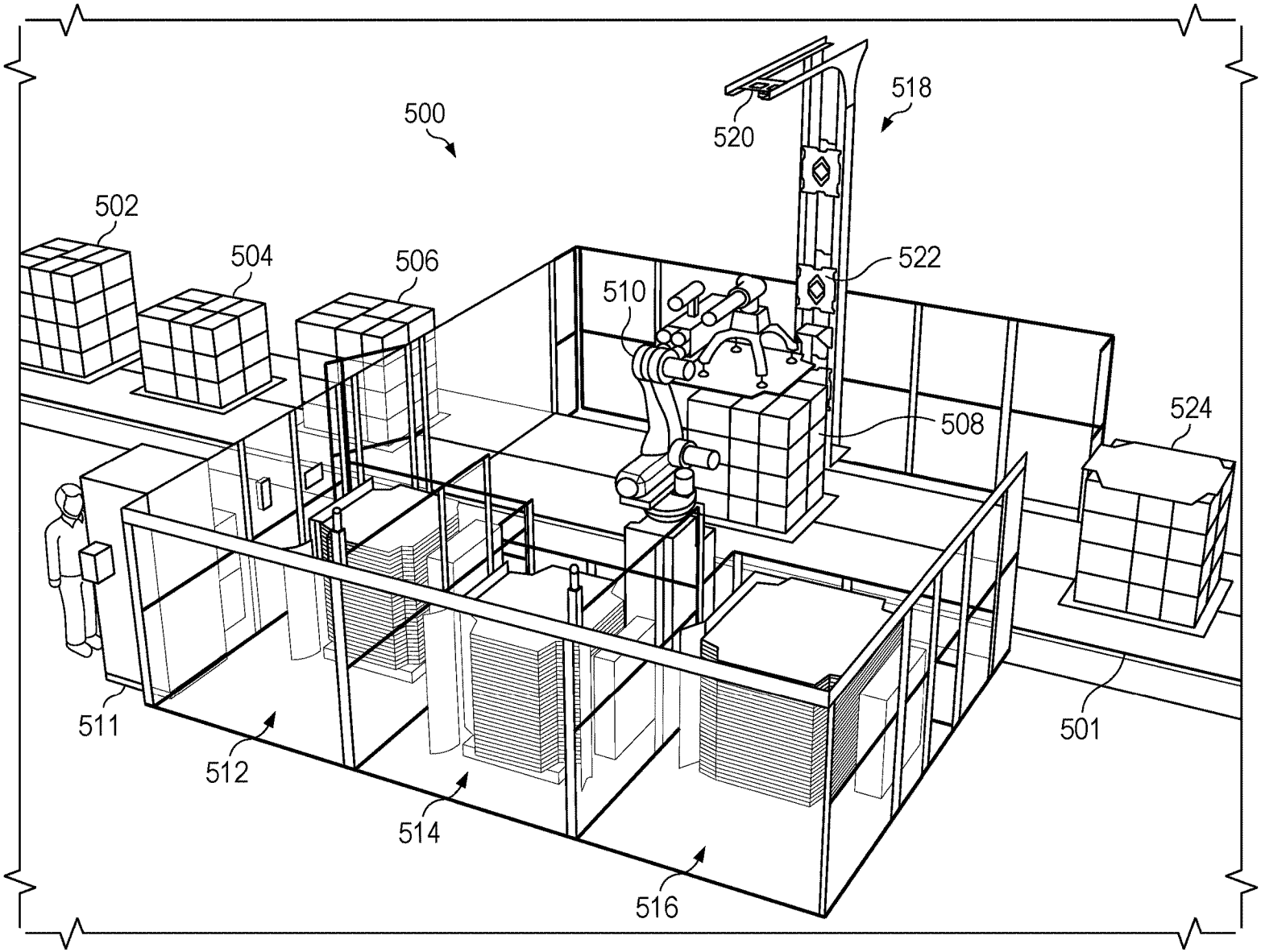
FIG. 5 depicts an example production arrangement of a possible implementation of the system of FIG. 2, according to various embodiments.

Finally, in operation 408, in embodiments, the dunnage may be secured along with the corrugated unit, such as by placement of straps over the corrugated unit and dunnage, or taping, stapling, boxing, and/or any other closure techniques FIG. 5 illustrates an example production arrangement 500 of a possible implementation of the system 200 depicted in FIG. 2. As can be seen in FIG. 5, a conveyor belt 501 carries a plurality of corrugated units 502, 504, 506, 508, and 524. Corrugated units 502, 504, and 506 are waiting to be moved into the fenced work area of production arrangement 500, to receive dunnage material. Corrugated unit 508, within the work area, is being serviced by the system, and corrugated unit 524, which has received dunnage material, has moved outside of the work area.

Within the work area, corrugated unit 508 is positioned in front of a robotic manipulator; in the depicted embodiment, the robotic manipulator is a robotic arm 510. The corrugated unit 508 remains on the conveyor belt 501. A gantry 518 is positioned opposite the robotic arm 510 and corrugated unit 508, and is equipped to carry the first vision system, a 3D camera 520, and the second vision system, a camera 522. 3D camera 520 is positioned overhead of the corrugated unit 508 so that it can ascertain its dimensions and position relative to the robotic arm 510.

On the opposite side of the robotic arm 510 from the corrugated unit 508 and gantry 518 are a plurality of dunnage stacks, each of which are in a respective bay 512, 514, and 516. As can be seen, each of the dunnage stacks is of a different size, corresponding to the different possible sizes of corrugated units 502, 504, and 506. As discussed above with respect to FIGS. 1-4, a server or processing unit, such as PLC 511, receives input from the 3D camera 520 and, based on this input, determines the size and shape of the corrugated unit 508. This determined size and shape is then used to select an appropriate size of dunnage material from one of the plurality of stacks in bays 512, 514, or 516. The PLC 511 then directs the robotic arm 510 to pick a piece of dunnage material from the selected stack.

Once the selected piece of dunnage material is picked, the robotic arm 510 transports it to corrugated unit 508 in view of the camera 520. Based on input from the camera 520, the PLC 511 directs the robotic arm 510 to place the dunnage piece atop the corrugated unit 508 and correctly align it so that it is placed in a position suitable for protecting the contents of the corrugated unit from subsequent strapping, packing, etc. This process may be repeated if multiple pieces of dunnage or necessary and/or desired for the corrugated unit 508.

Following placement of the piece or pieces of dunnage, the conveyor belt 501 moves the corrugated unit 508 with its topped dunnage piece or pieces out of the work area (e.g. to the position of corrugated unit 524), and moves the next waiting corrugated unit 506 into the work area to be similarly processed.

Figure 6:
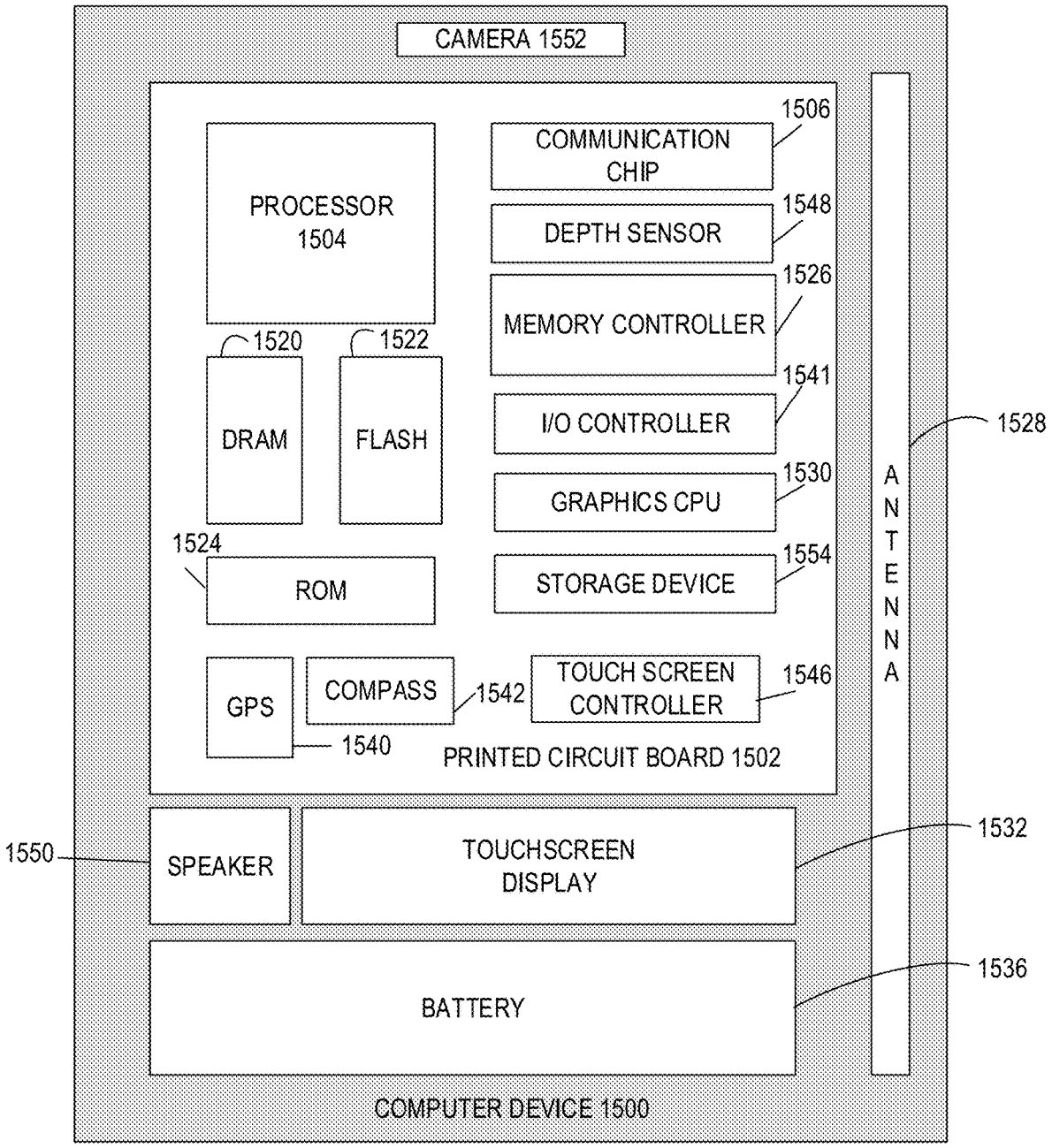
FIG. 6 is a block diagram of an example computer that can be used to implement some or all of the components of the disclosed systems and methods, according to various embodiments.

FIG. 6 illustrates an example computer device 1500 that may be employed by the apparatuses and/or methods described herein, in accordance with various embodiments. As shown, computer device 1500 may include a number of components, such as one or more processor(s) 1504 (one shown) and at least one communication chip 1506. In various embodiments, one or more processor(s) 1504 each may include one or more processor cores. In various embodiments, the one or more processor(s) 1504 may include hardware accelerators to complement the one or more processor cores. In various embodiments, at least one communication chip 1506 may be physically and electrically coupled to the one or more processor(s) 1504. In further implementations, the communication chip 1506 may be part of the one or more processor(s) 1504. In various embodiments, computer device 1500 may include printed circuit board (PCB) 1502. For these embodiments, the one or more processor(s) 1504 and communication chip 1506 may be disposed thereon. In alternate embodiments, the various components may be coupled without the employment of PCB 1502.

Depending on its applications, computer device 1500 may include other components that may be physically and electrically coupled to the PCB 1502. These other components may include, but are not limited to, memory controller 1526, volatile memory (e.g., dynamic random access memory (DRAM) 1520), non-volatile memory such as read only memory (ROM) 1524, flash memory 1522, storage device 1554 (e.g., a hard-disk drive (HDD)), an I/O controller 1541, a digital signal processor (not shown), a crypto processor (not shown), a graphics processor 1530, one or more antennae 1528, a display, a touch screen display 1532, a touch screen controller 1546, a battery 1536, an audio codec (not shown), a video codec (not shown), a global positioning system (GPS) device 1540, a compass 1542, an accelerometer (not shown), a gyroscope (not shown), a depth sensor 1548, a speaker 1550, a camera 1552, and a mass storage device (such as hard disk drive, a solid state drive, compact disk (CD), digital versatile disk (DVD)) (not shown), and so forth.

In some embodiments, the one or more processor(s) 1504, flash memory 1522, and/or storage device 1554 may include associated firmware (not shown) storing programming instructions configured to enable computer device 1500, in response to execution of the programming instructions by one or more processor(s) 1504, to practice all or selected aspects of method 100, system 200, and/or method 400 described herein. In various embodiments, these aspects may additionally or alternatively be implemented using hardware separate from the one or more processor(s) 1504, flash memory 1522, or storage device 1554.

The communication chips 1506 may enable wired and/or wireless communications for the transfer of data to and from the computer device 1500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 1506 may implement any of a number of wireless standards or protocols, including but not limited to IEEE 802.20, Long Term Evolution (LTE), LTE Advanced (LTE-A), General Packet Radio Service (GPRS), Evolution Data Optimized (Ev-DO), Evolved High Speed Packet Access (HSPA+), Evolved High Speed Downlink Packet Access (HSDPA+), Evolved High Speed Uplink Packet Access (HSUPA+), Global System for Mobile Communications (GSM), Enhanced Data rates for GSM Evolution (EDGE), Code Division Multiple Access (CDMA), Time Division Multiple Access (TDMA), Digital Enhanced Cordless Telecommunications (DECT), Worldwide Interoperability for Microwave Access (WiMAX), Bluetooth, derivatives thereof, as well as any other wireless protocols that are designated as 3G, 4G, 5G, and beyond. The computer device 1500 may include a plurality of communication chips 1506. For instance, a first communication chip 1506 may be dedicated to shorter range wireless communications such as Wi-Fi and Bluetooth, and a second communication chip 1506 may be dedicated to longer range wireless communications such as GPS, EDGE, GPRS, CDMA, WiMAX, LTE, Ev-DO, and others.

In various implementations, the computer device 1500 may be a laptop, a netbook, a notebook, an ultrabook, a smartphone, a computer tablet, a personal digital assistant (PDA), a desktop computer, smart glasses, or a server. In further implementations, the computer device 1500 may be any other electronic device that processes data.

As will be appreciated by one skilled in the art, the present disclosure may be embodied as methods or computer program products. Accordingly, the present disclosure, in addition to being embodied in hardware as earlier described, may take the form of an entirely software embodiment (including firmware, resident software, micro-code, etc.) or an embodiment combining software and hardware aspects that may all generally be referred to as a "circuit," "module" or "system." Furthermore, the present disclosure may take the form of a computer program product embodied in any tangible or non-transitory medium of expression having computer-usable program code embodied in the medium.

Figure 7:
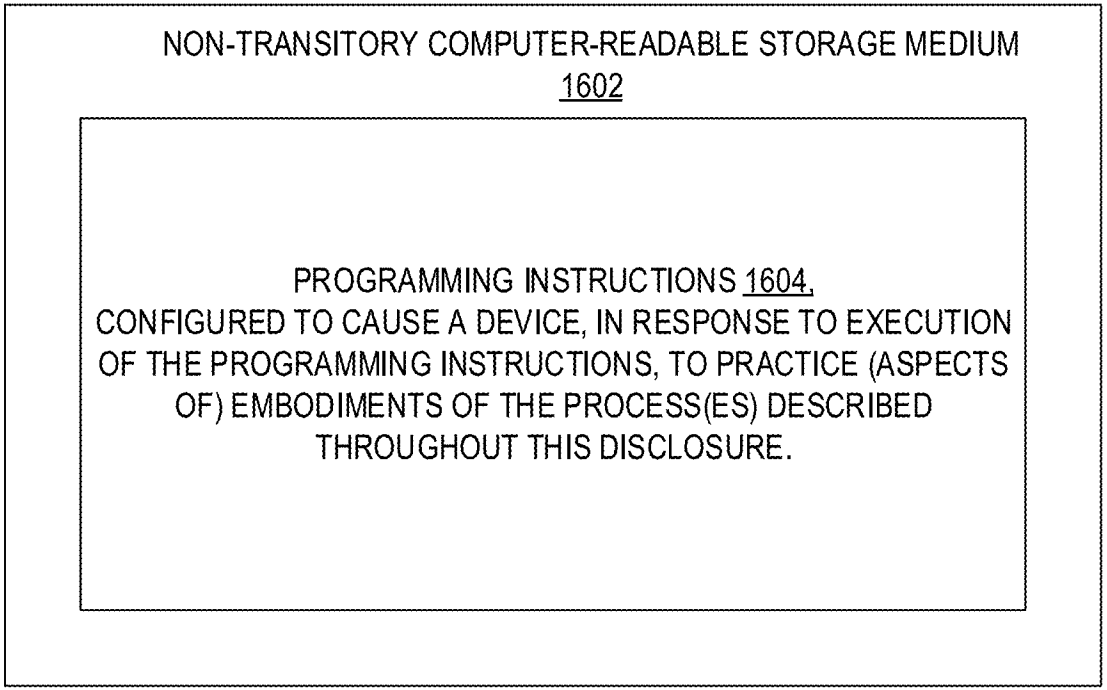
FIG. 7 is a block diagram of a computer-readable storage medium that can be used to implement some of the components of the system or methods disclosed herein, according to various embodiments.

FIG. 7 illustrates an example computer-readable non-transitory storage medium that may be suitable for use to store instructions that cause an apparatus, in response to execution of the instructions by the apparatus, to practice selected aspects of the present disclosure. As shown, non-transitory computer-readable storage medium 1602 may include a number of programming instructions 1604. Programming instructions 1604 may be configured to enable a device, e.g., computer 1500, in response to execution of the programming instructions, to implement (aspects of) method 100, system 200, and/or method 400 described above. In alternate embodiments, programming instructions 1604 may be disposed on multiple computer-readable non-transitory storage media 1602 instead. In still other embodiments, programming instructions 1604 may be disposed on computer-readable transitory storage media 1602, such as, signals.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present disclosure is described with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A method, comprising:

receiving into a predefined space a corrugated unit to a preset position;

analyzing, using a first vision system, the corrugated unit to determine a size, shape, and position within the predefined space of the corrugated unit;

determining, from the size, shape, and position of the corrugated unit, a dunnage material size and placement on the corrugated unit;

picking, using a robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions;

presenting, by the robotic manipulator, the piece of dunnage material to a second vision system to determine alignment information; and aligning, by the robotic manipulator based on feedback from the second vision system, the piece of dunnage material to the corrugated unit based on the alignment information.

2. The method according to claim 1, wherein the robotic manipulator is controlled by a programmable logic controller (PLC).

3. The method according to claim 2, wherein the PLC receives input from the first vision system and the second vision system, and uses the input to control the robotic manipulator.

4. The method according to claim 1, wherein the corrugated unit is received into the predefined space to the preset position via a conveyor.

5. The method according to claim 1, further comprising placing, by the robotic manipulator, the piece of dunnage material onto the corrugated unit according to the determined placement and the alignment information.

6. The method according to claim 1, further comprising:

providing, by the robotic manipulator, the piece of dunnage material to a folding station to fold one or more edges of the piece of dunnage material; and placing, by the robotic manipulator, the folded piece of dunnage material onto the corrugated unit according to the determined placement and the alignment information.

7. A system, comprising:

a first vision system;

a second vision system;

a robotic manipulator; and a programmable logic controller (PLC) in data communication with the first vision system, the second vision system, and the robotic manipulator, wherein the PLC is programmed to:

analyze, using input from the first vision system, a packaged product to determine a size, shape, and position within a predefined space of the packaged product;

determine, from the size, shape, and position of the packaged product, a dunnage material size and placement on the packaged product;

pick, using the robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions;

present, with the robotic manipulator, the piece of dunnage material to the second vision system to determine alignment information; and align, by the robotic manipulator based on feedback from the second vision system, the piece of dunnage material to the packaged product based on the alignment information.

8. The system according to claim 7, wherein the packaged product is received into the predefined space to a preset position via a conveyor.

9. The system according to claim 7, wherein the first vision system, the second vision system, or both, comprise 3D cameras.

10. The system according to claim 7, wherein the PLC is further programmed to place, with the robotic manipulator, the piece of dunnage material onto the packaged product according to the determined placement and the alignment information.

11. The system according to claim 7, wherein the PLC is further programmed to:

provide, with the robotic manipulator, the piece of dunnage material to a folding station to fold one or more edges of the piece of dunnage material; and place, with the robotic manipulator, the folded piece of dunnage material onto the packaged product according to the determined placement and the alignment information.

12. The system according to claim 7, wherein the packaged product is a corrugated unit.

13. A non-transitory computer readable medium (CRM) comprising instructions that, when executed by an apparatus, cause the apparatus to:

analyze, using input from a first vision system, a corrugated unit to determine a size, shape, and position within a predefined space of the corrugated unit;

determine, from the size, shape, and position of the corrugated unit, a dunnage material size and placement on the corrugated unit;

pick, using a robotic manipulator, a piece of dunnage material that matches the dunnage material size from a plurality of dunnage material in a plurality of second preset positions, wherein at least two pieces of the plurality of dunnage material have different sizes and are located in corresponding different ones of the plurality of second preset positions;

present, with the robotic manipulator, the piece of dunnage material to a second vision system to determine alignment information; and align, with the robotic manipulator based on feedback from the second vision system, the piece of dunnage material to the corrugated unit based on the alignment information.

14. The CRM of claim 13, wherein the corrugated unit is received into the predefined space to a preset position via a conveyor.

15. The CRM according to claim 13, wherein the first vision system, the second vision system, or both, comprise 3D cameras.

16. The CRM according to claim 13, wherein the instructions further cause the apparatus to place, with the robotic manipulator, the piece of dunnage material onto the corrugated unit according to the determined placement and the alignment information.

17. The CRM according to claim 13, wherein the instructions further cause the apparatus to:

provide, with the robotic manipulator, the piece of dunnage material to a folding station to fold one or more edges of the piece of dunnage material; and place, with the robotic manipulator, the folded piece of dunnage material onto the corrugated unit according to the determined placement and the alignment information.

18. The CRM according to claim 13, wherein the apparatus is a programmable logic controller that is in data communication with the first vision system, the second vision system, and the robotic manipulator.

* * * * *